US006302028B1

(12) United States Patent
Guillot-Ulmann et al.

(10) Patent No.: US 6,302,028 B1
(45) Date of Patent: Oct. 16, 2001

(54) NON-LETHAL PROJECTILE WITH FINE GRAIN SOLID IN ELASTIC INFRANGIBLE ENVELOPE

(75) Inventors: Richard Guillot-Ulmann, Pierre Semard; Gerard Hamy, Joseph Cauvin, both of (FR)

(73) Assignee: Isher (S.A.R.L.) (FR)

( * ) Notice: Subject to any disclaimer, the term of this patent is extended or adjusted under 35 U.S.C. 154(b) by 0 days.

(21) Appl. No.: 09/297,930

(22) PCT Filed: Sep. 11, 1998

(86) PCT No.: PCT/FR98/01945

§ 371 Date: May 11, 1999

§ 102(e) Date: May 11, 1999

(87) PCT Pub. No.: WO99/14551

PCT Pub. Date: Mar. 25, 1999

(30) Foreign Application Priority Data

Sep. 12, 1997 (FR) ..... 97 11361

(51) Int. Cl.[7] ..... F42B 8/00; F42B 12/34; F42B 12/00

(52) U.S. Cl. ..... 102/502; 102/444; 102/513; 102/529

(58) Field of Search ..... 102/395, 444, 102/498, 502, 513, 529, 703

(56) References Cited

U.S. PATENT DOCUMENTS

| | | | | |
|---|---|---|---|---|
| 3,865,038 | | 2/1975 | Barr | 102/92.7 |
| 3,952,662 | * | 4/1976 | Greenlees | 102/502 |
| 4,430,941 | * | 2/1984 | Raech, Jr. et al. | 102/496 |
| 4,656,092 | * | 4/1987 | Human et al. | 102/502 |
| 4,686,905 | * | 8/1987 | Szabo | 102/444 |
| 5,402,729 | * | 4/1995 | Richert | 102/502 |
| 5,450,795 | * | 9/1995 | Adelman | 102/502 |
| 5,565,649 | * | 10/1996 | Tougeron et al. | 102/502 |
| 5,936,190 | * | 8/1999 | Buzick | 102/502 |

FOREIGN PATENT DOCUMENTS

| | | |
|---|---|---|
| WO 95/00815 | 1/1995 | (WO) . |
| WO 95/23952 | 9/1995 | (WO) . |

* cited by examiner

*Primary Examiner*—Harold J. Tudor
(74) *Attorney, Agent, or Firm*—Duane Morris & Heckscher LLP

(57) ABSTRACT

A very highly deformable projectile comprising at least one envelope that is fine, flexible, and elastic, filled with a divided solid substance, deformation thereof occurring only on impact, and of a diameter that is sufficient to limit penetration on impact with energy being rapidly spread out by instantaneous enlargement.

3 Claims, 3 Drawing Sheets

NON-LETHAL PROJECTILE WITH FINE GRAIN SOLID IN ELASTIC INFRANGIBLE ENVELOPE

The present invention relates to a controlled-deformation projectile, particularly but not exclusively intended for use at short range to incapacitate people or animals in ordinary order-maintaining or riot-control operations without giving rise to irreversible lesions.

BACKGROUND OF THE INVENTION

Various "incapacitating" projectiles are known for use in order-maintaining operations. They are of various shapes, being spherical or rod-shaped, and they act by the effect of the impact that occurs on kinetic energy being transformed when contact is made with the target. Whatever their caliber (12-bore, i.e. 18 mm, or 35 mm, 37 mm, 38 mm, 44 mm, and 56 mm), these projectiles all share the characteristics of being light in weight and of moving at high velocity, with their deformability at the moment of impact remaining rather relative, and in nearly all cases depending on the elastic qualities of the materials used.

In other known projectiles, the looked-for objectives are to obtain a soft impact effect or to disperse a liquid or a powder on a target person.

These high velocities are associated with the fact that in order to obtain good accuracy and a sufficiently large impact effect, on the basis of criteria concerning the energy of the round, its muzzle velocity from a launcher must be high. The mass of the projectile that is put into motion is small, so a large propellant charge is required to obtain proper combustion and firing that is regular. Such rounds therefore operate in a manner that is similar to that of conventional projectiles. The surfaces of such projectiles need to be relatively rigid in order to avoid any in-flight deformation which could spoil accuracy at such velocities.

Because of this rigidity and because of the high elastic qualities of the round, its impact area remains much the same as the area of its initial caliber. In addition, since the impact is pseudo-elastic, a portion of the energy $E=\frac{1}{2}MV^2$ of the projectile is lost in rebound and in heat of deformation. This point is particularly true when the target has a hard portion. To mitigate this drawback, manufacturers propose "spring" type mechanisms for breaking into a plurality of portions or for stretching, which mechanisms are indirect ways of consuming energy to prevent rebound and to lengthen the duration of impact so as to come closer to the effect of a soft impact.

Fragmentation is to be avoided, not only because it departs from soft impact, but also because it can give rise to severe localized lesions.

Although the energy that is, in fact, dissipated in the target is an essential criterion, that assumes that the impact can be thought of as a soft impact in which all of the momentum $Q=MV$ is uniformly transferred from the projectile to the target. To do this, it is necessary for the projectile to be very highly deformable on impact and for it to have minimum elasticity on the impact axis so as to avoid any rebound.

OBJECTS AND SUMMARY OF THE INVENTION

An object of the present invention is to mitigate the drawbacks of conventional rounds by obtaining a large amount of momentum at lower velocities, thereby optimizing impact area, given the high degree of deformability associated with quasi-zero elasticity on the firing axis, and thus making it possible to remain highly reproducible regardless of the (hard or soft) part of the target that is hit in terms of energy dumped per unit area, and consequently easier to adapt so as to avoid giving rise to irreversible lesions.

The invention seeks:

- to control the fluidity of the projectile or of the bodies making it up. In addition to problems of unbalance and thus of inaccuracy when firing, excessive fluidity gives rise to severe problems on impact. A body that is too fluid will tend, during compression on impact, to penetrate into the cavity created at the point of impact. For example, a semi-solid fluid such as Plasticine can have a very high degree of disrupting and cavitating effect, which is to be avoided;
- to eliminate any body having a disruptive effect. For example, any disrupter used for destroying objects or suspects based on water or on explosive aqueous gels;
- to avoid problems associated with low temperature operation and using a fluid that contains water;
- to avoid any premature disruption or bursting of the projectile on being fired since that would lead to using wads that are quite strong for guidance and protection purposes, thereby also giving rise to a problem of separation on leaving the firing barrel; and
- to avoid defining a stable and accurate shape for the projectile when at rest, outside its cartridge.

According to the invention, the projectile that is very highly deformable on impact and that is for the purpose of incapacitating by the effect of impact, comprises at least one flexible, elastic, and extensible envelope filled with at least one divided solid. The divided solid may be a powder or a substance having small grain size.

In the invention, the envelope is fine or very fine, e.g. having a thickness of less than 0.5 millimeters (mm) and is selected so that it does not impose a shape on the projectile, while nevertheless conserving its coherence. The projectile is thus amorphous, i.e. it does not have its own shape and its shape memory is minimal or non-existent. During an impact or sudden stop on the target aimed at, the projectile collapses along the firing axis and deforms radially (for an impact at normal incidence on a plane surface). Because of inertia, the grains of the substance are compressed along the firing axis at substantially zero velocity (relative to the surface of the target). The radial deformation produced by this compression causes the elastic envelope to expand radially in instantaneous manner and makes it possible to obtain uniform distribution of the energy that is transferred to the target. Naturally, the result obtained depends on the diameter of the envelope and on the mass of the grains included therein. The deformable projectile for neutralizing by the impact effect can be launched by a firearm, or by a weapon that is pneumatic or mechanical, and it may optionally be in the form of a cartridge, propelled by powder, by a gas, or by a spring. The present invention seeks to distribute the force of the impact over an area that is enlarged so as to avoid giving rise to excessively large amounts of trauma. In the examples mentioned below, the term "proximity" is used to mean a distance in the range zero to 50 meters.

The substance used for filling the flexible envelope is of grain size in the range less than 1 micron to 100 microns, depending on the surface coefficient of friction of the substance used, regardless of its origin, and it retains sufficient cohesion when traveling along the launch barrel and when in flight to prevent any undesirable deformation. In non-limiting manner, it may for example be a powder or a set of powders having grain size of about 1 micron, or it may be optionally hollow balls of glass, of PVC, or of Teflon (PTFE), with diameters of up to 100 microns, or it may be an arbitrary assembly of substances of these types.

The invention makes it possible to mitigate the drawbacks of prior art projectiles. In particular, the fluidity of the projectile depends on the nature and the grain size of the divided solid, and these parameters can be controlled during manufacture; the effect obtained is the result of a body which is neither a liquid nor an aqueous gel, thereby avoiding disruptive effects. The projectiles are stable at all temperatures of use. Since the projectile is amorphous, on being fired it suffices for it to be compressed in a cartridge and for it to be protected against heat. A simple skirt separates very easily from the projectile on leaving the barrel. The projectile is amorphous, i.e. it has no defined shape outside the cartridge, nor does it have shape memory. It therefore does not present any energy distribution on the firing axis at the moment of impact and it deforms solely as a function of the impact and not as a function of its own shape.

Preferably, the density of the projectile is close to that of the human body, thereby ensuring optimum energy transfer while minimizing the risk of penetration at the point of impact. On being fired, the projectile is compressed and takes the shape of the cartridge, occupying all of the volume available, and in flight it conserves a shape that is approximately cylindrical, thereby avoiding any unbalance, thus making accurate shooting possible.

It is also possible, optionally in association with such substances in granular or bead form, to use a material that is homogeneous, highly deformable, elastic, and capable of being subjected to large amounts of elongation.

Weights vary depending on the diameters, velocities, and origins of the substance. For example, in the light of testing: 1 kg of powder substance, such as No. 45 cooking flour having a grain size of about 1000th of a millimeter (which substance is taken merely as an example), makes it possible to manufacture twenty 40 mm projectiles each having a real diameter of 45 mm and a mass of 50 grams when the envelopes are closed. Such projectiles are subject to a small amount of deformation in order to enable them to be inserted into a barrel or a cartridge, and after initial acceleration they return to their natural shape by contracting (going from an egg-shape to a spherical shape). The inertia of the filler substance deforms the envelope, with little granular substance remaining in the center and with the majority of the substance being ejected from the periphery of the envelope. Deformation which would impair accuracy cannot take place during firing since the projectile is molded and held by the firing barrel once the filler material is in place, applying a small amount of force relative to the nominal diameter of said barrel (forcing an egg-shape that returns to a more or less spherical shape after leaving the barrel).

The strength and the empty diameter of the envelope(s) are a function of the selected caliber, velocity, and mass of the filler substance(s). The mass of the filler substance(s) is a function of the selected caliber and velocity. For a firing barrel having a diameter of 40 mm, the diameter of the empty projectile should be about 30 mm. The diameter of 40 mm to 45 mm is obtained after 50 grams of filler substance have been inserted and compacted. The final diameter of the projectile is obtained by compacting and it is possible to vary weights within a given caliber over a range of ±25%, whatever the caliber. The compacting pressure depends on the instantaneous area obtained on impact (other things being equal).

On average, for a 40 mm projectile weighing 50 grams and launched at 60 meters per second (m/s), the impact observed in Plasticine (Plastilina) at 17° C. has a diameter of more than 75 mm and creates a depression of a few millimeters. This amounts to dumping energy in quasi-uniform manner at 2 J/cm$^2$ when transmitting momentum of 30 N.m/s. By way of comparison, hollow spherical elastic rounds of very similar caliber presently on the market and recognized as being the closest to the non-lethal criterion, which is still poorly defined, deliver energy of 9 J/cm$^2$ over a diameter of less than 40 mm, with the momentum transfer being slightly smaller.

BRIEF DESCRIPTION OF THE DRAWINGS

Other advantages and characteristics of the invention will appear on reading the following description of particular embodiments that are given purely by way of non-limiting example and with reference to the accompanying drawings, in which.

MORE DETAILED DESCRIPTION

Figure 1:
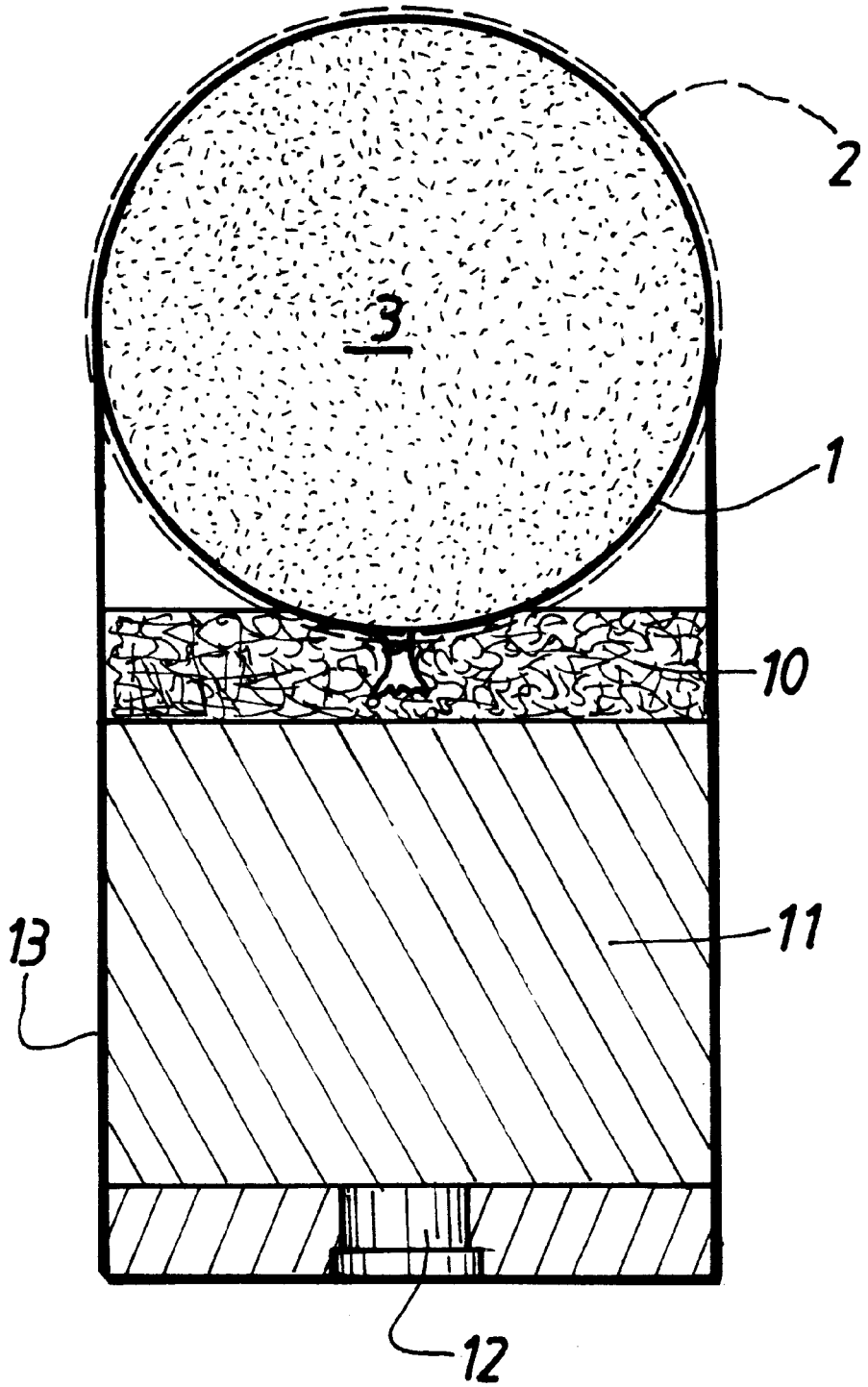
FIG. 1 is a section view of a projectile of the invention.
Figure 2:
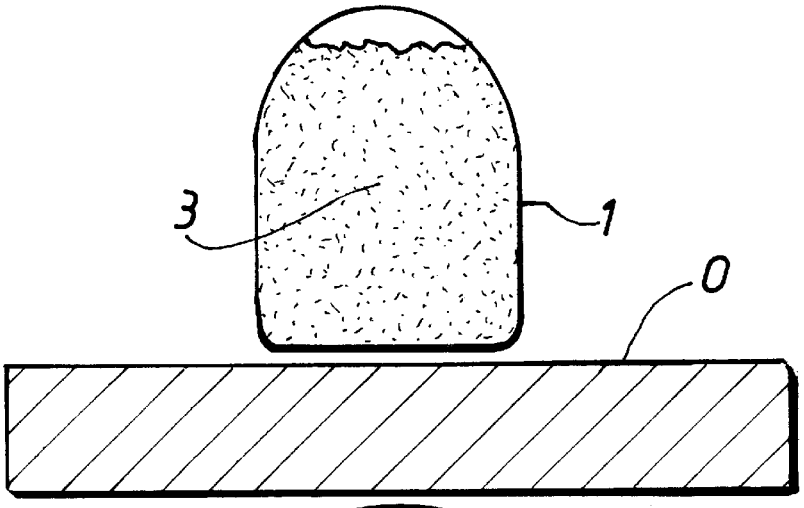
FIGS. 2 to 5 show how the projectile deforms on impact when the projectile contains solely substances in the form of grains or beads having diameters of less than 100 microns.

In FIG. 1 which is a vertical section view of a projectile, the following can be seen:

- a two-envelope structure 1, 2 filled with the filler component 3;
- final closure of the envelope(s) 1, 2 being provided by any conventional means such as heat sealing, adhesive, binding, etc. By way of example, the envelope 1 can be made of rubber. It can be lined with a second envelope 2 so as to provide better mechanical strength as a function of in-flight velocities. It is important for the envelopes to be under tension so as to conserve elasticity which, given the small initial inertia and the retention provided by the firing barrel enables it to conserve its shape, and thus its accuracy, with final deformation being obtained solely by inertia at the moment of instantaneous coming to rest on the target.

In the example shown, the projectile is included in a case or cartridge 13 which holds the bottom of the projectile against a wad 10, against which there is a propellant charge 11, and a primer 12. Any other propulsion means could be used.

Figure 3:
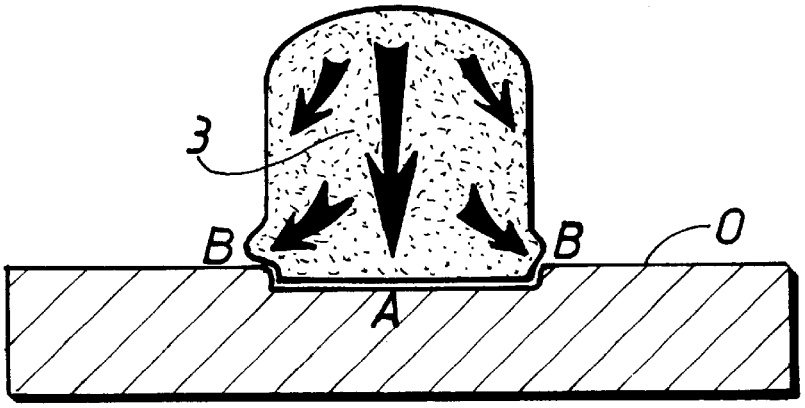
Figure 4:
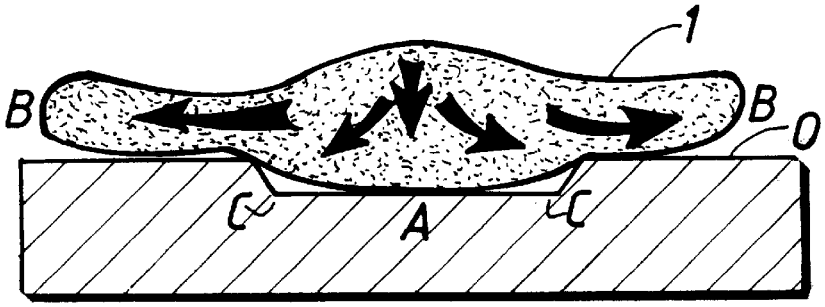

In FIGS. 2 to 5, the various stages of projectile modification on impact on a target 0 as observed during testing can be followed. In FIG. 3, it can be seen that on impact and after causing minimum penetration of a zone A, the filler substance expands radially under the effect of the axial compression due to the inertia of its motion on the firing axis, as represented by arrows (no references). This radial expansion due to the grains sliding over one another exerts radial pressure on the envelope(s) made of an elastic material that is capable of lengthening without breaking until the entire zone B has been formed (FIG. 4). After impact, the elasticity of the envelope(s) returns zone B to smaller dimensions.

The inertia in zone A which corresponds to the zone of primary contact, decreases in power without penetration increasing because the filler substance escapes into zone B, thereby spreading the impact over a large area.

Zone C (FIG. 5) shows the maximum spread of the primary impact. This final result is due to the interaction between the elasticity of the envelope(s) 1 and/or 2 and the mass of the substance 3.

In order to minimize the zone C due to compression of the material along the firing axis, it is also possible to place material 4 within the projectile (FIGS. 6 to 9).

Figure 5:
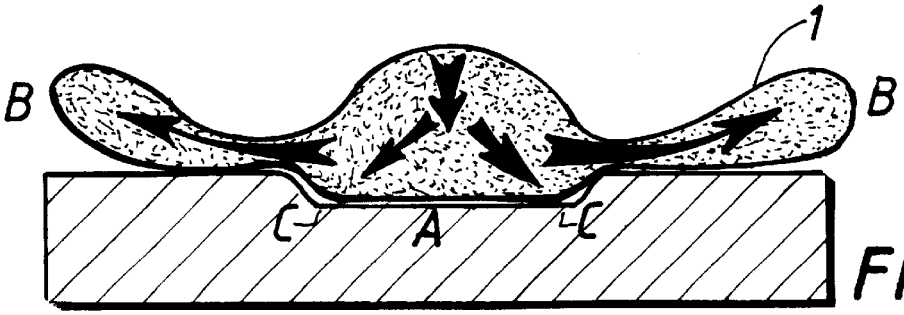
Figure 6:
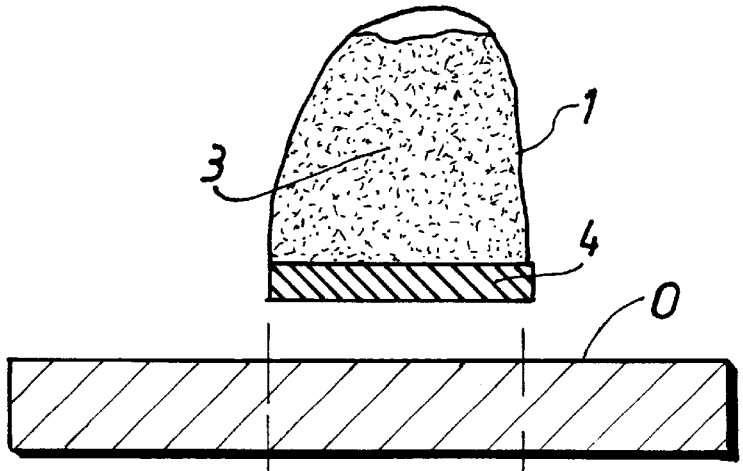
FIGS. 6 to 9 show how the projectile deforms in a second embodiment where the projectile also contains material that is homogeneous, highly deformable, elastic, and capable of being subjected to large amounts of elongation.
Figure 7:
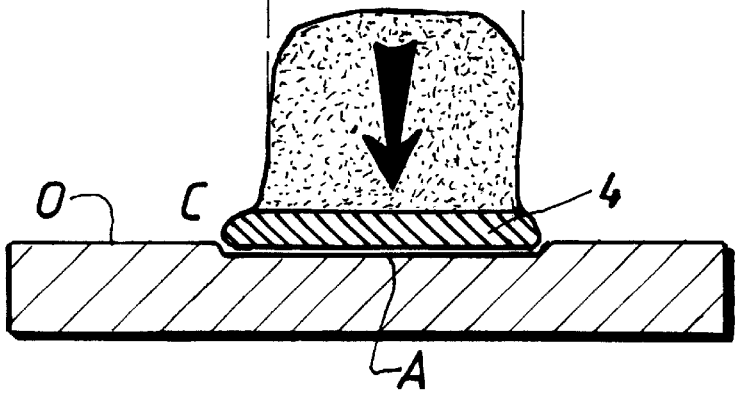

The material 4 used is homogeneous, highly deformable, elastic, and capable of being subjected to large amounts of extension. In FIGS. 6 to 9, this material 4 which is of higher density than the compacted material 3 described with reference to FIGS. 1 to 5, is placed in a preferred version of the invention at the end of the envelope 1 so as to be located at the front of the projectile when fired, and it occupies a thickness that corresponds more or less in volume to the depression observed in zone C (FIG. 5). By way of example, this material 4 can be deposited in the form of a disk or of a spherical sector.

On impact (FIG. 7), the plastic material is subjected to compression and it flattens, and at this instant its deformation absorbs a portion of the acceleration that is normally received by the target, thereby creating a zone C that is shallower and of larger area.

Figure 8:
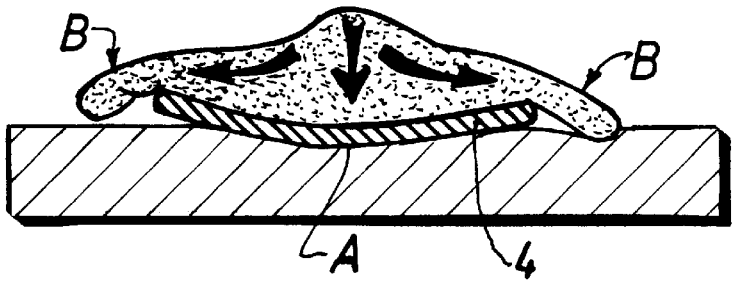

In FIG. 8, the zone B is created by going round the zone A which is occupied by the homogeneous material.

Figure 9:
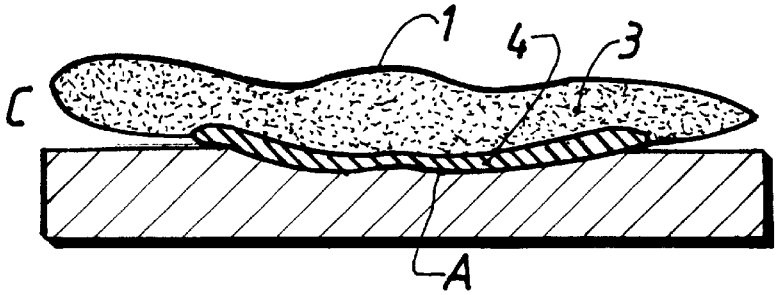

In FIG. 9, since the material 4 used absorbs shock waves, the wave reflected by the target is attenuated and the quantity of material remaining on the axis of zone C is decreased. The impact is thus better distributed and the observed depression is attenuated. The filler substance 3 may be inert or it may include a dye that wears off after several days so as to enable individuals to be identified quickly. More generally, the substance 3 may include one or more active substances for subsequent identification of a target, such as dye (in the visible spectrum or otherwise) or an odor-producing substance (e.g. as detected by sensors or by specially trained animals).

In another application, the projectile of the invention can be fired at velocities of at least 150 meters per second (which means it must not be used against people). It can then pass through a conventional door or window. The envelope tears and bursts at the moment of impact, thereby instantaneously releasing its contents in the form of a huge volume (cloud) of particles of substance, given the mass involved. The projectile could then contain, for example, and preferably, an incapacitating chemical in powder form of the OC type (oleoresin of capsicum) or its derivatives Capsaicine, CN (2-chloroacetophenone) or CS(O-chlorbenzylidenemalononitrile) or CR (dibenzoxazepine). Such a projectile, fired at a distance, thus serves to incapacitate large numbers of people without the risks of fire associated with using conventional smoke bombs in closed premises. When the envelope tears, the active substance is propelled forwards under its own inertia by its velocity, exceeding the elastic limits of the envelope(s). The projectile passes through and bursts on hitting the obstacle, thereby considerably reducing the risk of direct impact against a person situated on the other side of the obstacle.

What is claimed is:

1. A projectile for projectile weapons, having a longitudinal firing axis, for non-lethal impact on a target, comprising:

at least one flexible elastic extensible infrangible envelope defining a longitudinal axis aligned with the firing axis, the envelope having a thickness less than 0.5 millimeters and the envelope being filled with only solid material divided into grains, said grain, having a grain size smaller than 100 microns, wherein upon impact on the target, the envelope deforms radially outwardly relative to the firing axis, by relative displacement of the grains within the envelope, thereby spreading the projectile over an impact area to maximize impact and minimize trauma.

2. A projectile according to claim 1 whereas said divided solid is constituted of at least one powder substance of grain size of about one micron.

3. A projectile according to claim 1 further comprising a portion of homogeneous, elastic and extensible material disposed at a front of the projectile along the firing axis.

* * * * *